US009403401B2

(12) United States Patent
Rosen et al.

(10) Patent No.: US 9,403,401 B2
(45) Date of Patent: Aug. 2, 2016

(54) THERMAL ERASER FOR TACTILE DRAWINGS

(71) Applicant: University of Vermont and State Agricultural College, Burlington, VT (US)

(72) Inventors: Michael Rosen, Burlington, VT (US); Michael Coleman, South Burlington, VT (US); Joshua Coffee, South Burlington, VT (US); William David Banks, Saratoga Springs, NY (US); Kristin Leigh Funabashi, Brookline, MA (US); Rebecca Risko, Ferndale, MI (US); Akie Hashimoto, Durham, NC (US); Keegan Jennings Brown, Roxbury, MA (US); Katherine Accomando, Beverly, MA (US)

(73) Assignees: University of Vermont and State Agricultural College, Burlington, VT (US); National Federation For The Blind, Baltimore, MD (US)

( * ) Notice: Subject to any disclaimer, the term of this patent is extended or adjusted under 35 U.S.C. 154(b) by 692 days.

(21) Appl. No.: 13/685,002

(22) Filed: Nov. 26, 2012

(65) Prior Publication Data

US 2013/0075385 A1 Mar. 28, 2013

Related U.S. Application Data

(63) Continuation of application No. 13/457,725, filed on Apr. 27, 2012, now abandoned.

(60) Provisional application No. 61/482,175, filed on May 3, 2011.

(51) Int. Cl.
*H05B 3/42* (2006.01)
*B43L 19/00* (2006.01)

(52) U.S. Cl.
CPC ..... *B43L 19/00* (2013.01); *B43L 19/0043* (2013.01)

(58) Field of Classification Search
CPC ..... G06F 3/033
USPC ..... 434/112, 113, 114; 178/2 R, 18.01, 178/19.01; 345/156, 173–179; 219/233
See application file for complete search history.

(56) References Cited

U.S. PATENT DOCUMENTS 2,616,198 A 11/1952 Sewell
3,667,139 A 6/1972 Barr (Continued)

OTHER PUBLICATIONS http://americanthermoform.com/category/products/thermoform-machines/ (Last viewed Apr. 29, 2015).

(Continued)

*Primary Examiner* — Dana Ross
*Assistant Examiner* — Joseph Iskra
(74) *Attorney, Agent, or Firm* — Downs Rachlin Martin PLLC

(57) ABSTRACT

A thermal eraser for erasing tactile drawing features from a tactile drawing medium, along with methods of erasing tactile drawing features formed on a tactile drawing medium, are disclosed. The thermal eraser has a heated tip that can be heated to a temperature sufficient to cause the tactile drawing feature to flow back into the surface of the tactile drawing medium. The heated tip has a tip temperature that can be controlled by a temperature-regulating circuit. A set-point temperature can be used to set the tip temperature and maintain the tip temperature. The thermal eraser can be controlled by hand or by an electro-mechanical device such as a tactile printer.

19 Claims, 7 Drawing Sheets

(56) References Cited

U.S. PATENT DOCUMENTS

| | | | | |
|---|---|---|---|---|
| 3,768,180 | A | 10/1973 | Arrdal | |
| 5,502,967 | A * | 4/1996 | Nakagawa | B43K 8/22 219/216 |
| 5,529,501 | A * | 6/1996 | Maruyama | B43K 8/22 345/179 |
| 2003/0016282 | A1 * | 1/2003 | Koizumi | 347/143 |
| 2006/0231109 | A1 * | 10/2006 | Howell et al. | 128/898 |
| 2010/0238620 | A1 * | 9/2010 | Fish | 361/679.09 |
| 2012/0235935 | A1 * | 9/2012 | Ciesla | G06F 3/0202 345/173 |
| 2013/0107144 | A1 * | 5/2013 | Marhefka et al. | 349/12 |
| 2013/0229386 | A1 * | 9/2013 | Bathiche et al. | 345/175 |

OTHER PUBLICATIONS https://www.youtube.com/watch?v=foyc4KzmG9g (ATC Brailon Duplicator: A Brief Tutorial) (Last viewed Apr. 29, 2015).

http://store.humanware.com/hus/piaf-picture-in-a-flash-tactile-graphic-maker.html (Last viewed Apr. 29, 2015).

https://www.youtube.com/watch?v=Xa7cKxSk584 (PAIF Making Tactile Graphics) (Last viewed Apr. 29, 2015).

* cited by examiner

THERMAL ERASER FOR TACTILE DRAWINGS

RELATED APPLICATION DATA

This application is a continuation of U.S. application Ser. No. 13/457,725, filed Apr. 27, 2012, and titled "Thermal Eraser For Tactile Drawings," which application claims the benefit of priority of U.S. Provisional Application Ser. No. 61/482,175, filed on May 3, 2011. Each of these applications is incorporated by reference herein in its entirety.

This application is also related to U.S. patent application Ser. No. 13/684,993 entitled "Systems For and Methods of Digital Recording and Reproduction of Tactile Drawings," which is being filed concurrently with the present application, and U.S. patent application Ser. No. 13/457,704, filed on Apr. 27, 2012, and titled "Systems For and Methods of Digital Recording and Reproduction of Tactile Drawings."

All references, publications, patent documents, etc. mentioned herein are incorporated herein by reference.

FIELD OF THE INVENTION

The present disclosure relates to tactile drawings and in particular to a thermal eraser for erasing tactile features on tactile drawings.

BACKGROUND OF THE INVENTION

Tactile drawings, also called raised-line drawings or RLDs, are produced and used primarily by the blind and sight-impaired because they allow tactile sensing in a free-hand drawing. With reference to FIG. 1, tactile drawings are formed in one example by a stylus 10 that is moved and controlled by a user relative to a surface 22 of a locally deformable medium 20, referred to hereinafter as a "tactile drawing medium." Tactile drawing medium 20 is configured to permanently or semi-permanently display one or more tactile drawing features 30 on surface 22 when localized pressure is applied to the surface with stylus 10. In particular, as a user moves stylus 10 over surface 22 of tactile drawing medium 20 with downward pressure, tactile feature 30 is formed thereon, with the tactile feature instantly revealing the stylus path. The resulting drawing is referred to herein as a tactile drawing 32.

A typical tactile drawing medium 20 comprises a thin plastic sheet, which can be a thermoplastic material (also called thermosoftening plastic), among others. Tactile drawing medium 20 is placed and secured (e.g., via a clip 40, as shown) on top of a pad of flexible or indentable material 24, such as rubber. Stylus 10 can be a typical ballpoint pen (or other rolling contact device), or can simply be a rod with a rounded or otherwise effectively shape tip 12. The force of stylus tip 12 on the flexible material 24 through tactile drawing medium 20 locally plastically deforms the tactile drawing medium to create a tactile feature 30. In an example, the tactile drawing medium responds along the stretched line produced by the stylus by rising instantaneously to become a palpable raised feature. This system has the benefit of letting a user feel what they are drawing while they draw it, and provides a permanent hardcopy of their tactile drawing that others can tactilely sense.

One limitation of tactile drawing medium 20 is that tactile features 30 cannot be removed or erased in a practical manner. Thus, the user does not have the benefit of being able to readily refine tactile drawing 32 by erasing some or all of a given tactile feature 30. Since making such changes is an essential part of the creative process of making a tactile drawing, the inability to erase some or all of a tactile drawing is a significant limitation on the state of the art.

SUMMARY OF THE INVENTION

An aspect of the disclosure is a thermal eraser for erasing a tactile feature from a tactile drawing medium. The thermal eraser includes a housing having a tip section and a back section. A voltage source is operably arranged within at least a portion of the back section. A thermal-tip assembly resides in the tip section and is in electrical contact with the voltage source. The thermal-tip assembly has a tip and a heating element. The voltage source provides a current to maintain the tip at a tip temperature sufficient to substantially flatten the tactile feature by the application of heat from the tip to the tactile feature.

Another aspect of the disclosure is the thermal eraser as described above, wherein the voltage source comprises one or more batteries.

Another aspect of the disclosure is the thermal eraser as described above, further comprising an activation switch configured to allow or interrupt the flow of current from the voltage source to the thermal-tip assembly.

Another aspect of the disclosure is the thermal eraser as described above, wherein the thermal-tip assembly includes a temperature-regulating circuit configured to control the flow of current from the voltage source to the heating element to that the tip can be maintained at a select temperature or within a select temperature range.

Another aspect of the disclosure is the thermal eraser as described above, wherein the temperature-regulating circuit includes a temperature sensor that senses the tip temperature.

Another aspect of the disclosure is the thermal eraser as described above, wherein the temperature-regulating circuit controls the flow of current from the voltage source to the heating element based on the measured tip temperature as compared to a set-point temperature that represents a select tip temperature.

Another aspect of the disclosure is the thermal eraser as described above, wherein the temperature-regulating circuit includes a control switch disposed between the voltage source and the heating element, and wherein the control switch responds to a control signal to conduct or interrupt the flow of current to the heating element to maintain the tip temperature at the select temperature or within the select temperature range.

Another aspect of the disclosure is the thermal eraser as described above, wherein the temperature-regulating circuit includes a comparator configured to compare first and second voltages corresponding to the measure temperature and the set-point temperature respectively, and provide the control signal in the form a control voltage to the control switch.

Another aspect of the disclosure is the thermal eraser as described above, wherein the temperature-regulating circuit provides a hysteresis that causes the tip temperature to stay within a controlled temperature range.

Another aspect of the disclosure is the thermal eraser as described above, wherein the tip is defined by a thermally conductive cap sized to fit over the heating element and the temperature-regulating circuit.

Another aspect of the disclosure is the thermal eraser as described above, wherein the temperature sensor resides within the thermally conductive cap and measures a temperature within the cap.

Another aspect of the disclosure is the thermal eraser as described above, wherein the tactile drawing medium is made of a plastic, and the tip temperature is maintained at about 170° F.

Another aspect of the disclosure is a method of erasing at least a portion of a tactile drawing feature formed in a surface of a tactile drawing medium. The method includes providing the tactile drawing medium with the tactile drawing feature formed thereon, with the tactile drawing medium made of a material such that the application of sufficient heat to the tactile drawing feature causes the tactile drawing feature to substantially flow back into the surface. The method also includes applying the heat with a heated tip disposed proximate to or in contact with the portion of the tactile drawing feature to cause the heated portion of the tactile drawing feature to substantially flow back into the surface of the tactile drawing medium.

Another aspect of the disclosure is the method as described above, further comprising the heated tip having a tip temperature of about 170° F.

Another aspect of the disclosure is the method as described above, wherein the heated tip has a tip temperature and is in thermal communication with a heating element, with the method further including controlling the tip temperature by controlling an amount of current flowing to the heating element.

Another aspect of the disclosure is the method as described above, wherein the act of controlling an amount of current flowing to the heating element is performed by comparing a measurement of the tip temperature to a set-point temperature.

Another aspect of the disclosure is the method as described above, further comprising using the comparison of the measured tip temperature to the set-point temperature to generate a control signal that controls a control switch that controls the flow of current to the heating element.

Another aspect of the disclosure is a method of erasing at least a portion of a tactile drawing feature formed in a surface of a thermoplastic tactile drawing medium. The method includes applying a select amount of heat from a thermal eraser having a heated tip to at least a portion of the tactile drawing feature by placing the heated tip proximate to or in contact with the portion of the tactile drawing feature. The method also includes moving the heated tip over at least the portion of the tactile drawing feature to cause the portion to become substantially flush with the surface of the tactile drawing medium.

Another aspect of the disclosure is the method as described above, further including providing downward pressure on the portion of the tactile drawing feature with the heated tip.

Another aspect of the disclosure is the method as described above, further including directing the thermal eraser with an electro-mechanical device, such as a tactile printer, operably connected to a computer.

Additional features and advantages of the disclosure are set forth in the detailed description that follows, and in part will be readily apparent to those skilled in the art from that description or recognized by practicing the disclosure as described herein, including the detailed description that follows, the claims, as well as the appended drawings.

It is to be understood that both the foregoing general description and the following detailed description are embodiments of the disclosure intended to provide an overview or framework for understanding the nature and character of the disclosure as it is claimed.

The claims are incorporated into and constitute part of the Detailed Description set forth below.

The drawings are included to provide a further understanding of the disclosure, and are incorporated into and constitute a part of this specification. The drawings illustrate various embodiments of the disclosure, and together with the description serve to explain the principles and operations of the disclosure.

Figure 1:
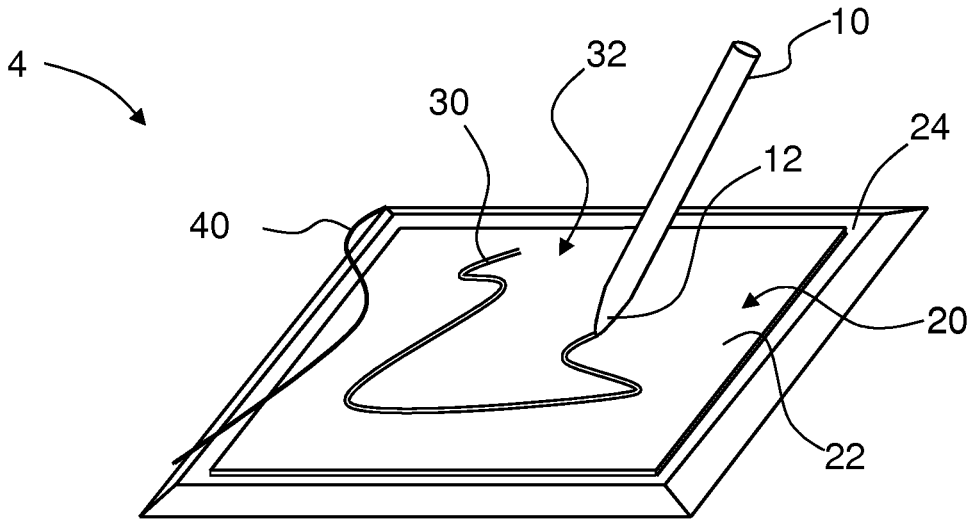
PRIOR ART FIG. 1
FIG. 1 is an elevated view of a prior art tactile system for creating a tactile feature in a tactile drawing medium in a conventional manner.
Figure 2:
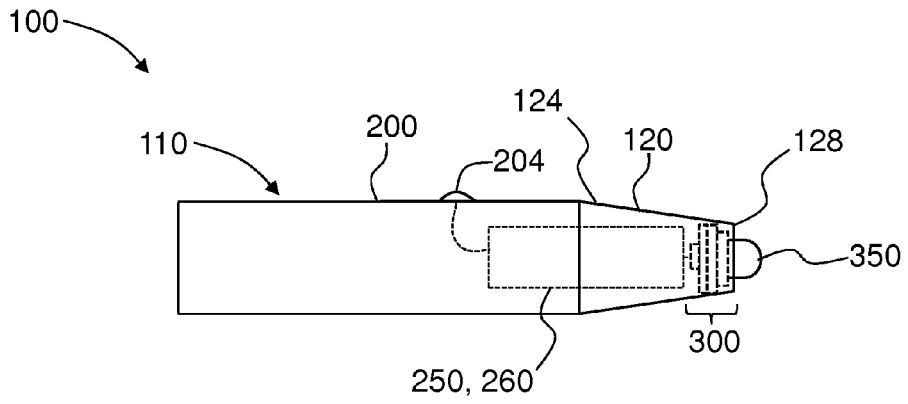
FIG. 2 is a side view of an example thermal eraser according to the disclosure, with certain internal components and structure shown in phantom.
Figure 3:
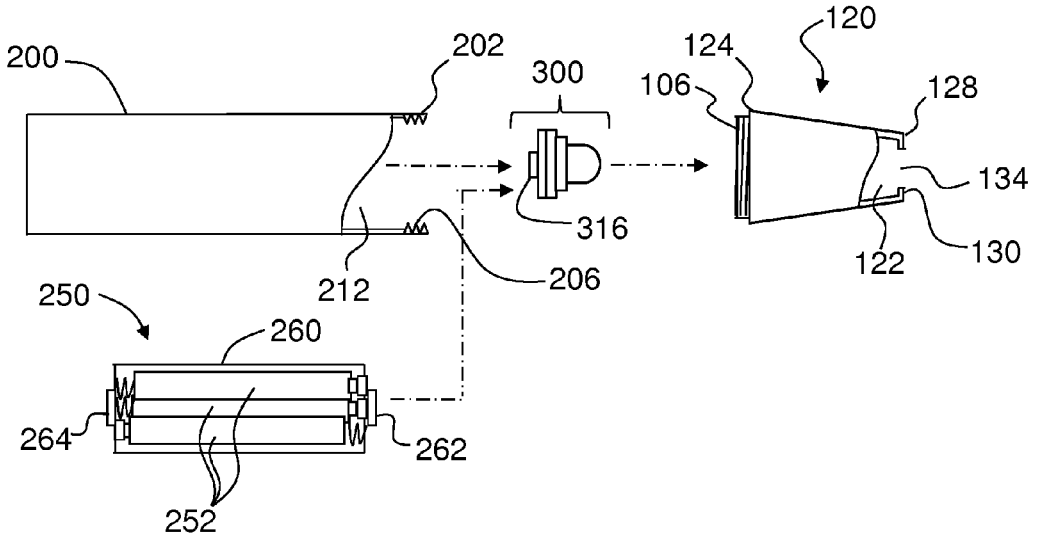
FIG. 3 is a partially exploded and partially cut-away side view of the thermal eraser of FIG. 2.

DETAILED DESCRIPTION OF THE INVENTION:

FIG. 2 is a side view of an example embodiment of a thermal eraser 100 according to the disclosure. FIG. 3 is a partially exploded and partially cut-away side view of the thermal eraser 100 of FIG. 2 and shows additional internal components and structure. Thermal eraser 100 includes a housing 110 that includes a tip section 120 and a cylindrical back section 200. Tip section 120 includes an open interior 122 and in an example has a wide end 124 and a narrow end 128. Wide end 124 includes an engaging feature 106, such as a lip or threads. Narrow end 128 includes an end wall 130 with a central aperture 134 formed therein.

Housing back section 200 includes an open front end 202 that includes a mating feature 206 configured to operably engage with engaging feature 106. Housing back section 200 has an interior 212 sized to accommodate a voltage source 250, such as one or more batteries 252. In an example, the one or more batteries 252 are operably held in a battery holder 260 that includes front and back electrical contacts 262 and 264 and that is configured to fit within the front portion of interior 212 of housing back section 200 at open end 202. Housing back section includes an activation switch 204 that is electrically connected to battery holder 260 and that allows the current from the voltage source 250 to be interrupted or to allow the current to flow, i.e., it turns the thermal eraser on and off.

In an example, activation switch 204 is configured to make a noise or otherwise trigger the generation of a sound so that a visually impaired user can know when thermal eraser 100 is on or off.

Figure 4:
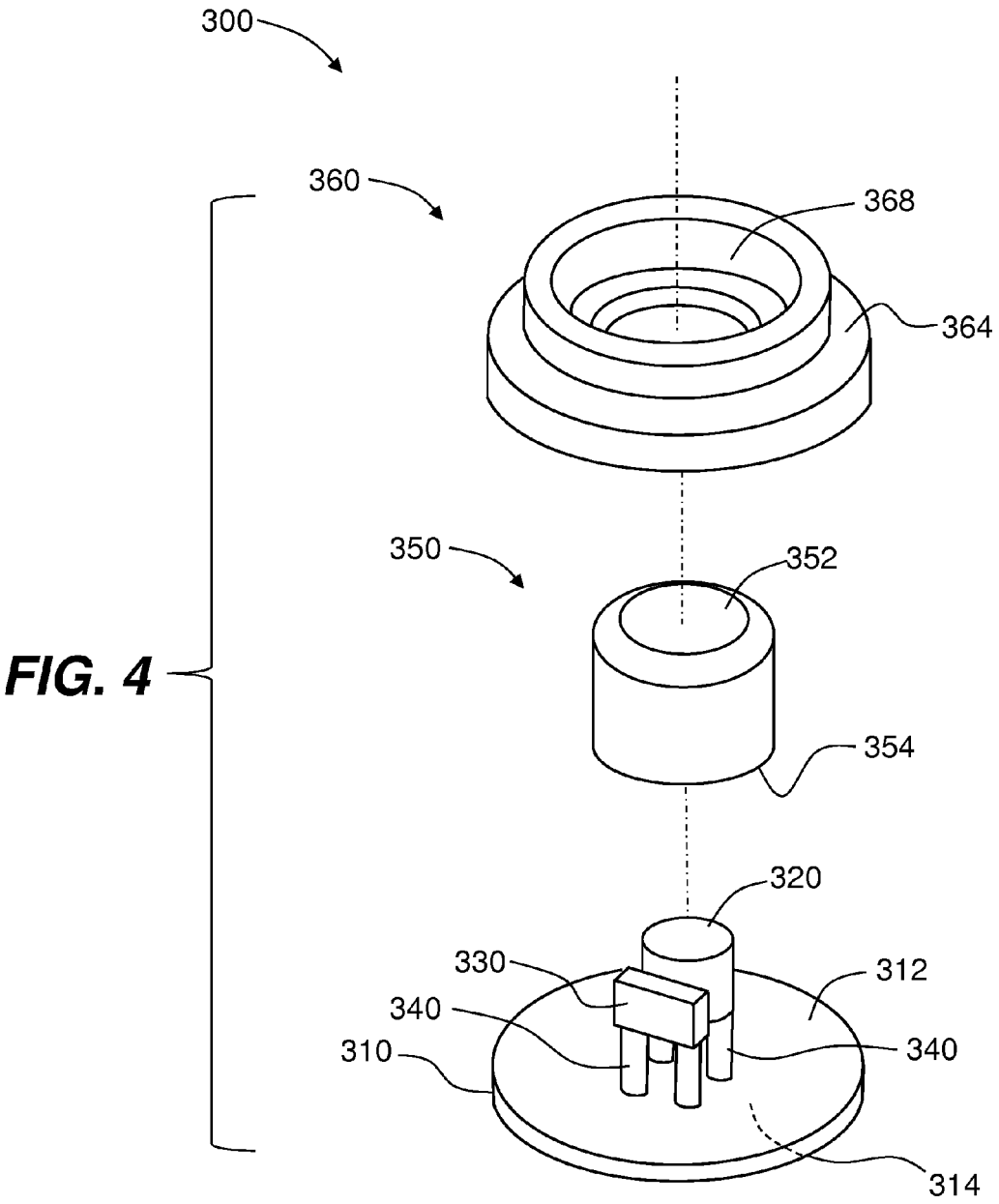
FIG. 4 is a partially exploded elevated view of an example thermal-tip assembly.
Figure 5A:
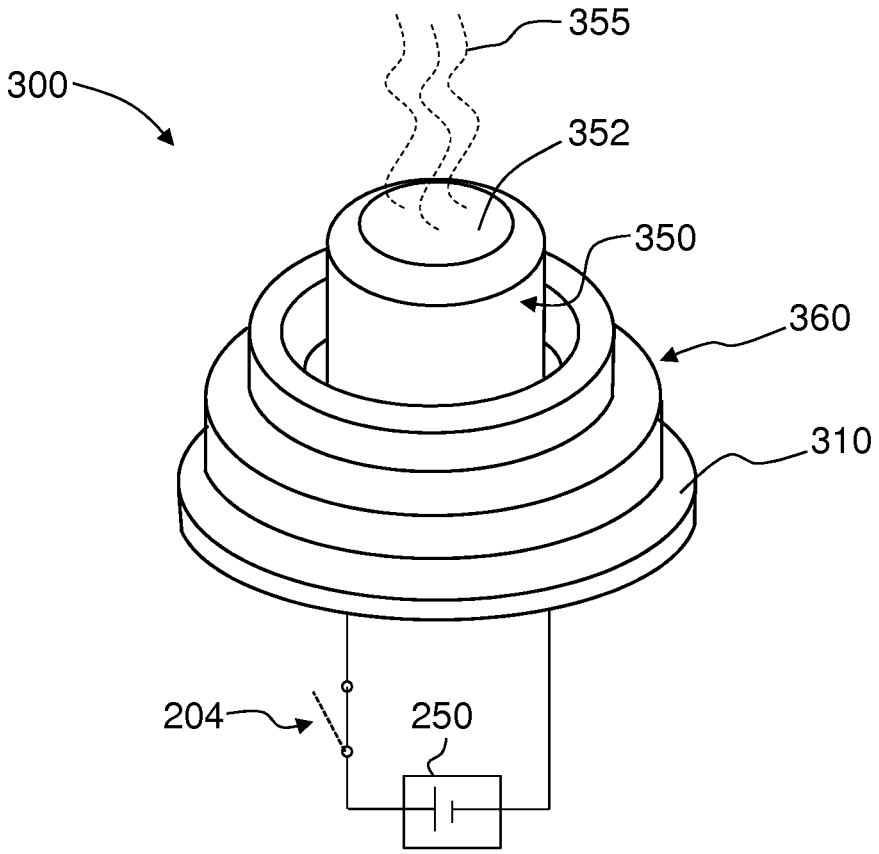
FIG. 5A is an elevated view of the thermal-tip assembly of FIG. 4, showing the basic electrical connection to one or more batteries, the activation switch, and also showing heat being generated at the tip.

Tip section 120 is sized to accommodate a thermal-tip assembly 300 as well as a portion of voltage source 250. FIG. 4 is a partially exploded view of an example thermal-tip assembly 300, while FIG. 5A is an elevated view of the thermal-tip assembly. Thermal-tip assembly 300 includes a printed circuit board (PCB) 310 having a top surface 312 and a bottom surface 314. PCB 310 operably supports on top surface 312 a heating element 320 and a temperature-regulating circuit 330 electrically connected thereto. Temperature-regulating circuit 330 can be in the form of integrated circuit (IC), as shown by way of illustration. An electrical contact 316 (not visible in FIG. 4; see FIG. 3) resides on bottom surface 314. Electrical leads 340 from electrical contact 326 pass through PCB to top surface 312 and to heating element 320 and temperature-regulating circuit 330.

With continuing reference to FIG. 4, thermal-tip assembly 300 also includes a thermally conductive cap 350 having a closed front end 352 and an open back end 354. Cap 350 is formed and sized to cover heating element 320 and temperature-regulating circuit 330 so that the cap open back end 354 rests on PCB top surface 312. An example cap 350 is made of from aluminum, and in a specific example is formed from a piece of ⅜" aluminum rod. Since cap 350 forms the heated tip of thermal eraser 100, cap 350 is also referred to hereinafter as heated tip (or just tip) 350.

Assembly 300 further includes an insulating sleeve 360 having a base 364 and a central aperture 368 sized to pass cap 350. An example material for insulating sleeve 360 is Polytetrafluoroethylene (PTFE), also known by the brand name TEFLON (DuPont Co.). Base 364 rests upon top surface 312 of PCB 310 when cap 350 extends through aperture 368. Insulating sleeve 360 serves to keep the heat 355 generated by heating element 320 within cap 350, thereby minimizing the flow or diffusion of heat 355 (see FIG. 5A) to unwanted areas of thermal eraser 100, and in particular to the portions of tip section 120 and housing back section 200 where a user would grip.

In an example embodiment, portions of tip section 120 and housing back section 200 can include an insulating (and preferably ergonomically designed) grip 220 (see FIG. 6B) to keep a user's hand (not shown) from being exposed to heat 355 generated by thermal-tip assembly 300. An alternative embodiment incorporates ventilation ports (not shown) around the tip to produce convective flow of heated air away from the grip surface.

Temperature-regulating circuit 330 is configured to regulate the tip temperature (i.e., the temperature of tip 350) by controlling the amount of electrical power provided to the heating element 320 from voltage source 250. In an example, the temperature of tip 350 (the "tip temperature") is maintained at about 170° F. by simply providing either a set or fluctuating amount of current to heating element 320, or via the action of temperature-regulating circuit 330.

Figure 5B:
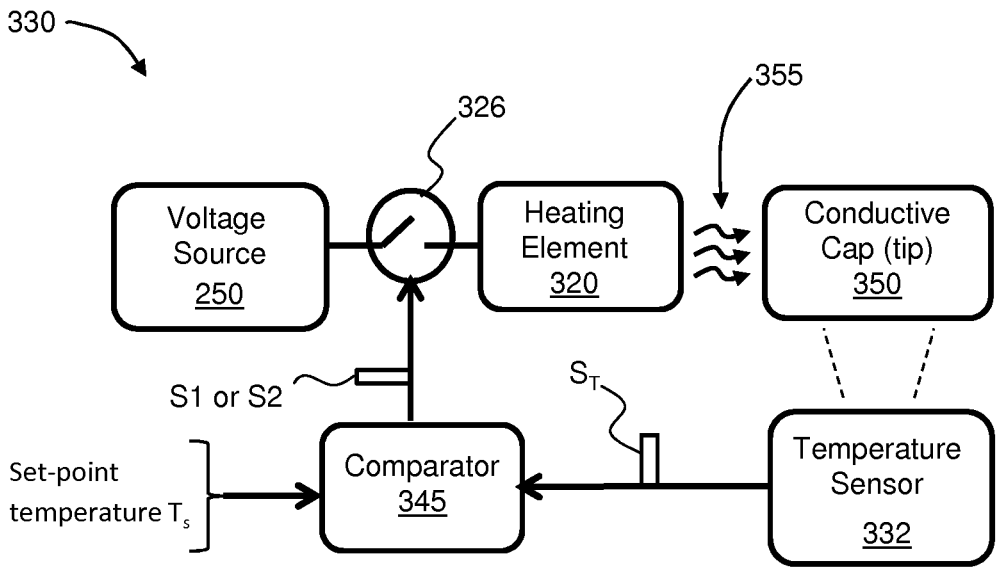
FIG. 5B is a schematic diagram of an example configuration for the temperature-regulating circuit that constitutes part of the thermal-tip assembly.

FIG. 5B is a schematic diagram of an example layout of temperature-regulating circuit 330. Temperature-regulating circuit 330 includes an internal temperature sensor 332 for sensing the tip temperature of conductive cap 350. Temperature-regulating circuit 330 is configured to regulate the amount of electrical power being delivered to the heating element from voltage source 250. In an example, this regulation function involves turning on and off the electrical current being delivered to heating element 320 to maintain a select tip temperature, or to maintain the tip temperature within a temperature range (e.g., a few degrees F.).

In an example, this is accomplished by providing a control switch 326 (e.g., a thermistor switch) between voltage source 250 and heating element 320. Temperature sensor 332 generates a temperature sensor signal $S_T$ corresponding to the measured tip temperature $T_M$ (i.e. the temperature of conductive cap 350). A comparator (e.g., an op-amp comparator or like element) 345 is disposed downstream of temperature sensor 332 and is operably connected to control switch 326. One input to comparator 345 is a voltage corresponding to set-point temperature $T_S$ while another input to the comparator is a voltage associated with temperature sensor signal $S_T$ corresponding to the measured tip temperature.

If the measured tip temperature $T_M$ from temperature sensor 332 exceeds the set-point temperature $T_S$, then comparator 345 generates a control voltage signal S2 that provided to control switch 326. Voltage signal S2 acts to open switch 326, thereby interrupting the flow of current. When the measured temperature $T_M$ drops below the set-point temperature $T_S$, then comparator 345 generates a voltage signal S1 that acts to close control switch 326, thereby allowing current to flow from voltage source 250 to heating element 320 to heat the tip 350.

In an example, PCB 310 includes two resistors R1 and R2 (not shown) electrically connected to temperature-regulating circuit 330. Resistor R1 controls the set-point temperature $T_S$, and resistor R2 controls a hysteresis that defines an amount of deviation from the set-point temperature $T_S$ that will be tolerated when regulating the flow of current from voltage source 250 to heating element 320.

Thermal-tip assembly 300 is operably supported by tip section 120 (see FIG. 2) so that cap 350 extends beyond narrow end 128 of the tip section and defines the heated tip of thermal eraser 100. With thermal-tip assembly 300 in place, voltage source 250 is inserted to housing back section 200 using, for example, the aforementioned battery holder 260 and batteries 252. An example battery holder 260 is cylindrical and configured to hold three batteries 252, such as three AAA batteries. Battery holder 260 is configured to fit into the interior 212 of housing back section 200 and in an example also extends into the interior 122 of the tip section 120 so that top electrical contact 262 of the battery holder comes into contact with bottom electrical contact 316 on PCB bottom surface 314. In another example, voltage source 250 could be inserted into the opposite end of housing back section 200 by removing thermal-tip assembly 300.

Figure 6A:
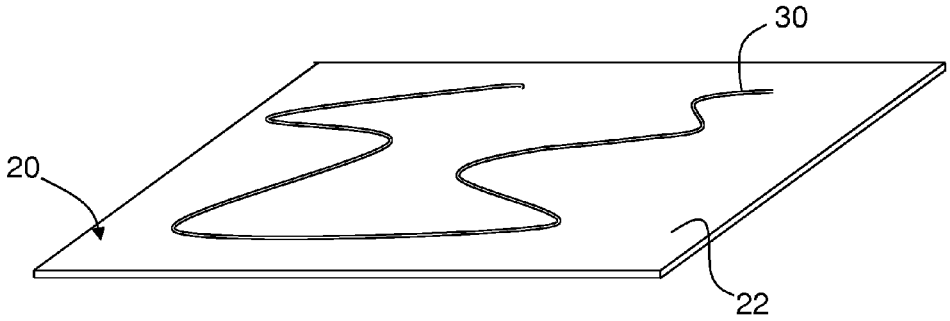
FIG. 6A shows an example tactile drawing feature on a tactile drawing medium.
Figure 6B:
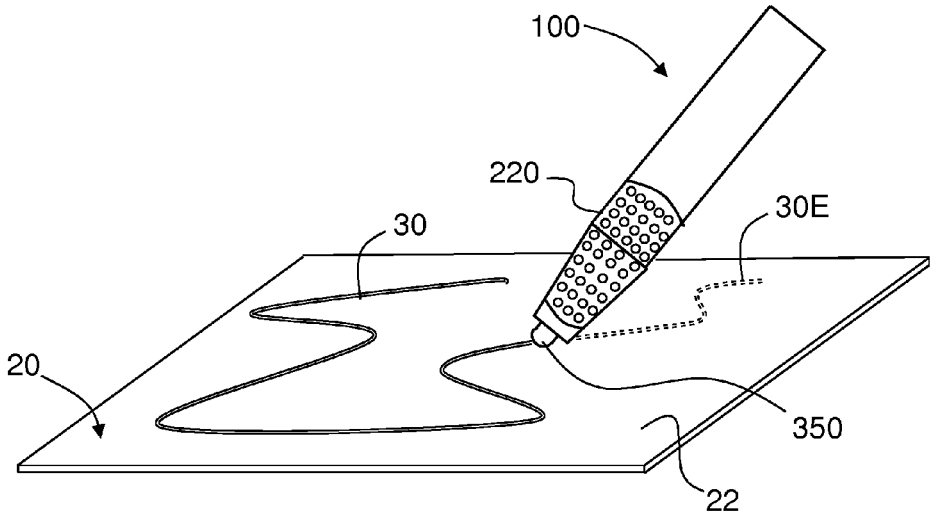
FIG. 6B shows the thermal eraser in the process of erasing a portion of the tactile drawing feature shown in FIG. 6A.

FIG. 6A shows a tactile drawing medium 20 that includes a tactile drawing feature 30 drawn thereon. FIG. 6B shows the same tactile drawing feature, but with a portion 30E having been erased by tracing heated tip 350 of thermal eraser 100 over a portion of the tactile drawing feature. In an example, the heated tip 350 causes the heated portion of tactile drawing feature 30 to soften, allowing the user to flatten the tactile drawing feature with very little downward pressure.

Depending on the material composition of tactile drawing medium 20, the process by which a raised line is flattened can vary. For example, the flattening process may be due to heat shrinking if tactile drawing medium is made of nylon or polyolefin. It is noted here that the terms "erase" and "erased" as used herein also include substantially removing as well as entirely removing an erased portion 30E of tactile drawing feature 30 so that it either can be slightly tactilely sensed and thus distinguishable from a non-erased tactile drawing feature 30, or cannot be tactilely sensed at all.

Thus, thermal eraser 100 flattens the portion of tactile drawing feature 30 to which heated tip 350 is applied. In an example, temperature-regulating circuit 330 is configured to maintain the temperature of tip 350 at about 170° F., which allows for tactile drawing feature 30 to be flattened by heat 355 from tip 350 without damaging tactile drawing medium 20. Other tip temperatures can be employed and will depend on the material making up tactile drawing medium 20. A suitable tip temperature is one that cause the tactile drawing feature 30 to substantially recede back into surface 22 of tactile drawing medium 20 without inducing thermal damage, especially the kind of thermal damage (e.g., blistering) that can be tactilely sensed by a visually impaired user and confused with the actual tactile drawing feature.

Additional Embodiments

Tip 350 is shown (e.g., see FIG. 5A) has having a flat front end 352. However, tip 350 can have a variety of suitable shapes, such as rounded or an angled flat surface, and can have a variety of surface areas, including surface areas large enough to erase more than one tactile feature 30 at a time.

Tactile drawing features 30 can be created and erased repeatedly with thermal eraser 100 much in the way that graphite pencil lines on paper can be created and removed repeatedly with a rubber eraser. In another example, if areas of raised lines or tactile drawing features are in place, selective erasing can be to draw or create new tactile drawing features 30 on a tactile drawing medium 20. Such new tactile drawing features 30 can be made to have a different texture than the original tactile drawing feature.

In an example embodiment, the tip temperature of thermal eraser 100 is selected (e.g., via the set-point temperature) to be suitable for the particular tactile drawing medium 20. Also, though the embodiment of thermal eraser 100 shown above utilizes an internal voltage source 250, a power cord that plugs into AC wall power can also be employed as the power (voltage) source.

Thermal eraser 100 can be used in a variety of ways. In one example, it can be picked up in the hand of the user, and directed (slid) along all or a portion of tactile drawing feature 30 while turned on. In an example, the application of pressure also assists in flattening the treated portions of tactile drawing feature 30.

Figure 7:
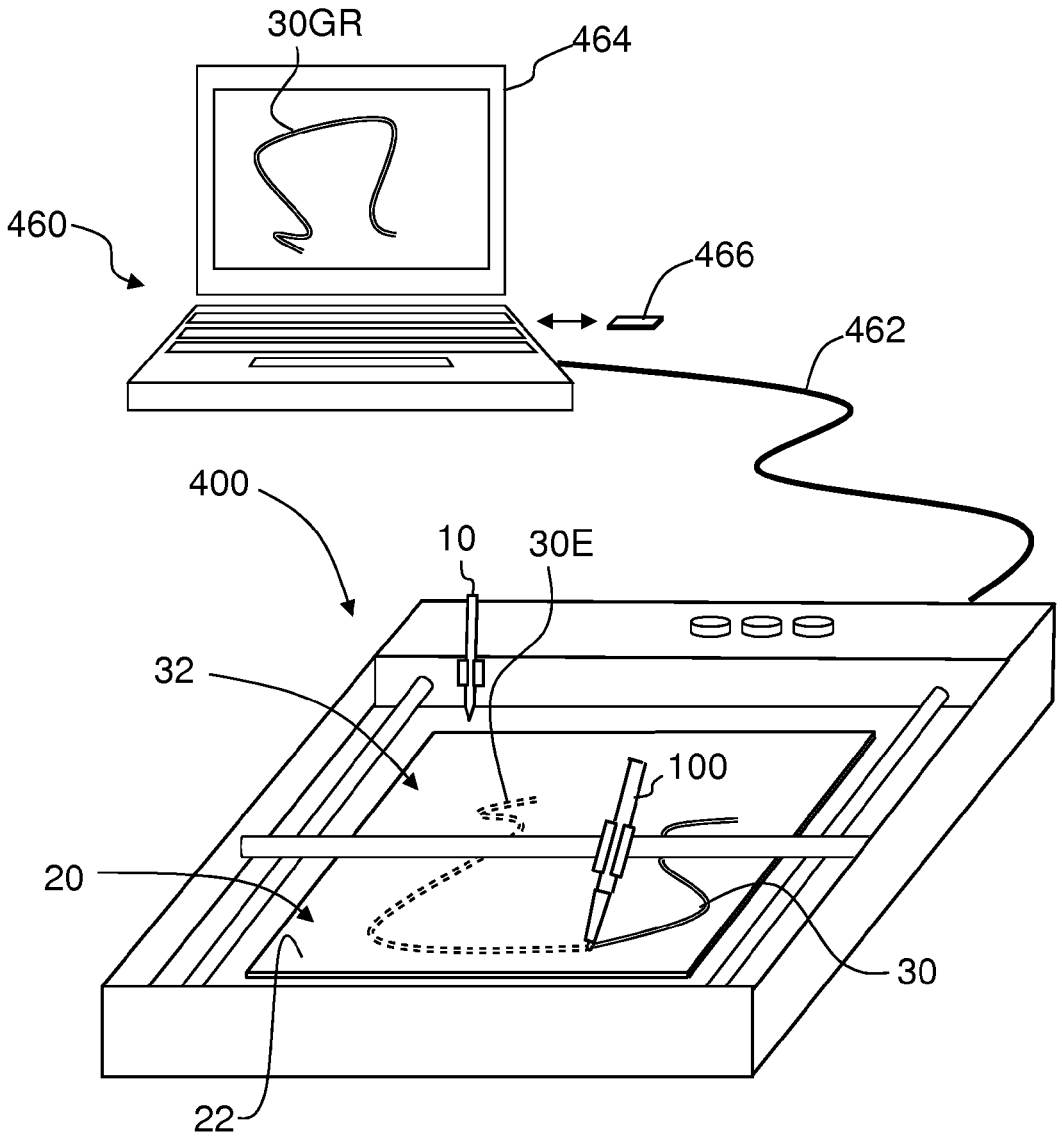
FIG. 7 is a schematic diagram of an electro-mechanical device in the form of a tactile printer operably connected to a computer, with the tactile printer having a tactile drawing therein and holding the thermal eraser in place of a stylus to erase a portion of the tactile drawing feature.

In an example illustrated in FIG. 7, instead of a human user handling thermal eraser 100, it can be held and then moved and controlled by an electro-mechanical device 400, such as a tactile printer. Tactile printer 400 is shown in FIG. 7 as being connected to a computer 460 via a cable 462 or a wireless connection (not shown). Computer 462 includes a visual representation 30GR (i.e., a visible graphics image) of tactile drawing feature 30, as shown on computer display 464. In an example, information for tactile drawing 32 is provided to computer 460 via a flash drive 466 or by any one of a number of known data transfer techniques.

In this embodiment, thermal eraser 100 can be selected by tactile printer 400 (either manually or automatically) and then used in a manner similar to how it uses stylus 10 to erase some or all of tactile drawing feature 30, as shown by the erased portion 30E.

Thermal-tip assembly 300 can also include a variety of different types of heating elements 320. In an example, heating element 320 is self-regulating, and does not require a closed-loop control circuit to maintain the tip temperature. In a more specific example, the heating element 320 comprises a self-regulating Positive-Temperature-Coefficient (PTC) heating element that maintains a constant tip temperature largely independent of the applied voltage from voltage source 250.

In another example, the heating element 320 is a conventional resistive heating element, and the heat 355 generated by thermal-tip assembly 300 is regulated only by a fixed voltage supplied to the heating element. If relatively constant ambient conditions prevail, a feedback circuit may not be necessary to control the tip temperature, as it would instead be controlled by a voltage source 250 in the form of a fixed-voltage power supply.

Aspects of the disclosure include method of erasing at least a portion of tactile drawing 30 feature formed in surface 22 of tactile drawing medium 20. One example method includes providing tactile drawing medium 20 with the tactile drawing feature 30 formed thereon, with the tactile drawing medium made of a material such that the application of sufficient heat 355 to the tactile drawing feature causes the tactile drawing feature to substantially flow (recede) back into surface 22 of tactile drawing medium 20. The method also includes applying the heat 355 with heated tip 350 disposed proximate to or in contact with the portion of tactile drawing feature 30 to cause the heated portion of the tactile drawing feature to substantially flow (recede) back into surface 22 of tactile drawing medium 20.

Another method of erasing includes applying a select amount of heat 355 from a thermal eraser 100 having a heated tip 350 to at least a portion of tactile drawing feature 30 by placing the heated tip proximate to or in contact with the tactile drawing feature. The method also includes moving heated tip 350 over at least a portion of tactile drawing feature 30 to cause the portion to become substantially flush with surface 22 of tactile drawing medium 20.

It will be apparent to those skilled in the art that various modifications and variations can be made to the present disclosure without departing from the spirit and scope of the disclosure. Thus, it is intended that the present disclosure cover the modifications and variations of this disclosure provided they come within the scope of the appended claims and their equivalents.

What is claimed is:

1. A thermal eraser for erasing a tactile feature from a tactile drawing medium, comprising:

a housing having a tip section and a back section;

a voltage source operably arranged within at least a portion of the back section; and a thermal-tip assembly that resides in the tip section and that is in electrical contact with the voltage source, the thermal-tip assembly having a tip and a heating element, wherein:

the voltage source provides a current to maintain the tip at a tip temperature sufficient to substantially flatten the tactile feature by the application of heat from the tip to the tactile feature;

the thermal-tip assembly includes a temperature-regulating circuit configured to control a flow of current from the voltage source to the heating element;

the tip is defined by a thermally conductive cap sized to contain the heating element and the temperature-regulating circuit; and the temperature-regulating circuit includes a temperature sensor that senses the tip temperature, wherein the temperature sensor:

resides within the cap;

measures a temperature within the cap and proximate the tip; and provides an indication of the measured temperature to the temperature-regulating circuit such that the temperature-regulating circuit causes the heating element to heat the cap to a temperature in excess of 135° F.

2. The thermal eraser according to claim 1, wherein the voltage source comprises one or more batteries.

3. The thermal eraser according to claim 1, further comprising an activation switch configured to allow or interrupt a flow of current from the voltage source to the thermal-tip assembly.

4. The thermal eraser according to claim 1, wherein the temperature-regulating circuit controls a flow of current from the voltage source to the heating element based on the measured tip temperature as compared to a set-point temperature.

5. The thermal eraser according to claim 4, wherein the temperature-regulating circuit includes a control switch disposed between the voltage source and the heating element, and wherein the control switch responds to a control signal to allow or interrupt a flow of current to the heating element to maintain the tip temperature.

6. The thermal eraser according to claim 5, wherein the temperature-regulating circuit includes a comparator configured to compare first and second voltages corresponding to the measure temperature and the set-point temperature respectively, and provide the control signal in the form a control voltage to the control switch.

7. The thermal eraser according to claim 5, wherein the temperature-regulating circuit provides a hysteresis that causes the tip temperature to stay within a controlled range.

8. The thermal eraser according to claim 1, wherein the tactile drawing medium is made of a plastic, and the tip temperature is maintained at about 170° F.

9. A method of erasing at least a portion of a tactile drawing feature formed in a surface of a tactile drawing medium, comprising:

providing the tactile drawing medium with the tactile drawing feature formed thereon, with the tactile drawing medium made of a material such that the application of heat having a temperature in excess of 135° F. to the tactile drawing feature causes the tactile drawing feature to substantially flow back into the surface; and applying the heat with a handheld device with a heated tip disposed proximate to or in contact with the portion of the tactile drawing feature to cause the heated portion of the tactile drawing feature to substantially flow back into the surface of the tactile drawing medium.

10. The method of claim 9, further comprising the heated tip having a tip temperature of about 170° F.

11. The method of claim 9, wherein the heated tip has a tip temperature and is in thermal communication with a heating element, with the method further comprising:

controlling the tip temperature by controlling an amount of current flowing to the heating element.

12. The method of claim 11, wherein said controlling an amount of current flowing to the heating element is performed by comparing a measurement of the tip temperature to a set-point temperature.

13. The method of claim 12, further comprising using the comparison of the measured tip temperature to the set-point temperature to generate a control signal that controls a control switch that controls a flow of current to the heating element.

14. A method of erasing at least a portion of a tactile drawing feature formed in a surface of a thermoplastic tactile drawing medium, comprising:

applying a select amount of heat having a temperature in excess of 135° F. from a handheld thermal eraser having a heated tip to at least a portion of the tactile drawing feature by placing the heated tip proximate to or in contact with the tactile drawing feature; and moving the heated tip over at least a portion of the tactile drawing feature to cause the at least portion to become substantially flush with the surface of the tactile drawing medium.

15. The method according to claim 14, further comprising providing downward pressure on the at least a portion of the tactile drawing feature with the heated tip.

16. The method according to claim 14, further comprising moving and controlling the thermal eraser with an electromechanical device operably connected to a computer.

17. The method of claim 14, the heated tip having a tip temperature of about 170° F.

18. The method of claim 14, wherein the heated tip has a tip temperature and is in thermal communication with a heating element, with the method further comprising:

controlling the tip temperature by controlling an amount of current flowing to the heating element, wherein said controlling an amount of current flowing to the heating element includes comparing a measurement of the tip temperature to a set-point temperature.

19. A thermal eraser for erasing a tactile feature from a tactile drawing medium, comprising:

a housing having a tip section and a back section;

a voltage source operably arranged within at least a portion of the back section;

a thermal-tip assembly that resides in the tip section and that is in electrical contact with the voltage source, the thermal-tip assembly having a tip and a heating element; and a temperature-regulating circuit configured to control a flow of current from the voltage source to the heating element, wherein:

the voltage source provides a current to maintain the tip at a tip temperature sufficient to substantially flatten the tactile feature by the application of heat from the tip to the tactile feature;

the tip is defined by a thermally conductive cap sized to contain the heating element; and the temperature-regulating circuit includes a temperature sensor that senses the tip temperature, wherein the temperature sensor:

resides within the cap;

measures a temperature within the cap and proximate the tip; and provides an indication of the measured temperature to the temperature-regulating circuit such that the temperature-regulating circuit causes the heating element to heat the cap to a temperature in excess of 135° F.

* * * * *